US012791277B2

(12) United States Patent
Brown

(10) Patent No.: US 12,791,277 B2
(45) Date of Patent: Nov. 10, 2026

(54) FIREARM SUPPRESSOR

(71) Applicant: Ronald Brown, Tolar, TX (US)

(72) Inventor: Ronald Brown, Tolar, TX (US)

( * ) Notice: Subject to any disclaimer, the term of this patent is extended or adjusted under 35 U.S.C. 154(b) by 93 days.

(21) Appl. No.: 18/445,676

(22) Filed: Jan. 22, 2025

(65) Prior Publication Data

US 2026/0210655 A1 Jul. 23, 2026

Related U.S. Application Data

(60) Provisional application No. 63/624,102, filed on Jan. 23, 2024.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4; 181/223
See application file for complete search history.

(56) References Cited

U.S. PATENT DOCUMENTS 3,713,362 A * 1/1973 Charron ..... F41A 21/30 89/14.4
9,599,421 B1 * 3/2017 Dean ..... F41A 21/30
2015/0338184 A1 * 11/2015 White ..... F41A 21/30 89/14.4
2019/0242667 A1 * 8/2019 Lo ..... F41A 21/30
2021/0333061 A1 * 10/2021 Muceus ..... F41A 21/30
2025/0362099 A1 * 11/2025 Helmikkala ..... F41A 21/30

FOREIGN PATENT DOCUMENTS

WO WO-2019203777 A1 * 10/2019 ..... F01N 1/085

* cited by examiner

*Primary Examiner* — Bret Hayes
(74) *Attorney, Agent, or Firm* — Brian K. Yost; Kiala E. Ellingson; Decker Jones, PC

(57) ABSTRACT

A firearm suppressor having a core with a tube and interior vanes is provided. The tube has first and second ends and an inner surface. The first and second ends are open. The vanes are located inside the tube and extend between the first and second ends. A vane extension member extends radially inward from the tube inner surface such that an outer end is nearer the tube inner surface than a free end. The arcuate component is located at the extension member free end. The arcuate components collectively circumscribe a circle. The vanes are separated from one another by outer cavities. The outer cavities are defined by the tube inner surface, the extension members and the arcuate components and are in fluid communication with an inner cavity located between the arcuate components. The inner cavity forms a projectile path.

17 Claims, 2 Drawing Sheets

FIREARM SUPPRESSOR

FIELD OF THE INVENTION

The present invention relates to suppressors for firearms.

BACKGROUND OF THE INVENTION

Suppressors are used on firearms to reduce the noise during firing. Much of the noise from a discharging firearm originates at the open end of the muzzle. The hot propellant gasses that force the projectile out of the barrel exit the barrel and experience a sudden pressure difference. This causes a loud bang.

A suppressor fits onto the end of the barrel. The suppressor provides a large volume relative to the barrel volume. The suppressor volume is baffled to slow the propagation of the propellant gasses. The gasses enter the suppressor, slow down and cool slightly, to reduce the level of noise.

There are many prior art suppressors. For example, Vais, U.S. Pat. No. 7,412,917 shows a suppressor having projectile path surrounded by an interrupted cylinder and transverse partial walls from an outer can to the cylinder. This forms a series of interrupted outer chambers around the projectile path to allow for expansion and cooling of the propellant gasses. These prior art suppressors are typically relatively expensive to manufacture. Also in the prior art are White, U.S. Pat. No. 9,874,418 and Michel, U.S. Pat. No. 9,140,511. White shows a suppressor with helical vanes. The vanes form chambers for noise suppression and also form lands that contact the passing projectile so as to provide rifling. Michel shows a heat exchanger that is located outside of a barrel.

It is desired to provide a noise suppressor that is inexpensive to manufacture.

DESCRIPTION OF THE PREFERRED EMBODIMENT

The suppressor 11 of the present invention provides enhanced noise suppression and is inexpensive to manufacture. The suppressor is used on a firearm such as a long gun (for example, a rifle) or a handgun. The suppressor 11 is located on the muzzle end of the firearm barrel in a conventional manner so that as the firearm projectile exits the muzzle, it passes through the suppressor 11. The suppressor 11 has longitudinally extending partitions 21. These partitions 21 are located so as to be exposed to the projectile gasses, but do not contact the projectile and thus do not form lands.

Figure 1:
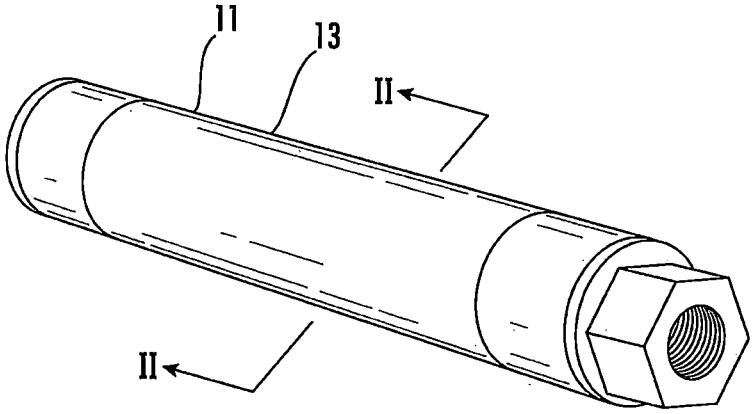
FIG. 1 is a perspective view of the suppressor of the present invention, in accordance with a preferred embodiment.
Figure 2:
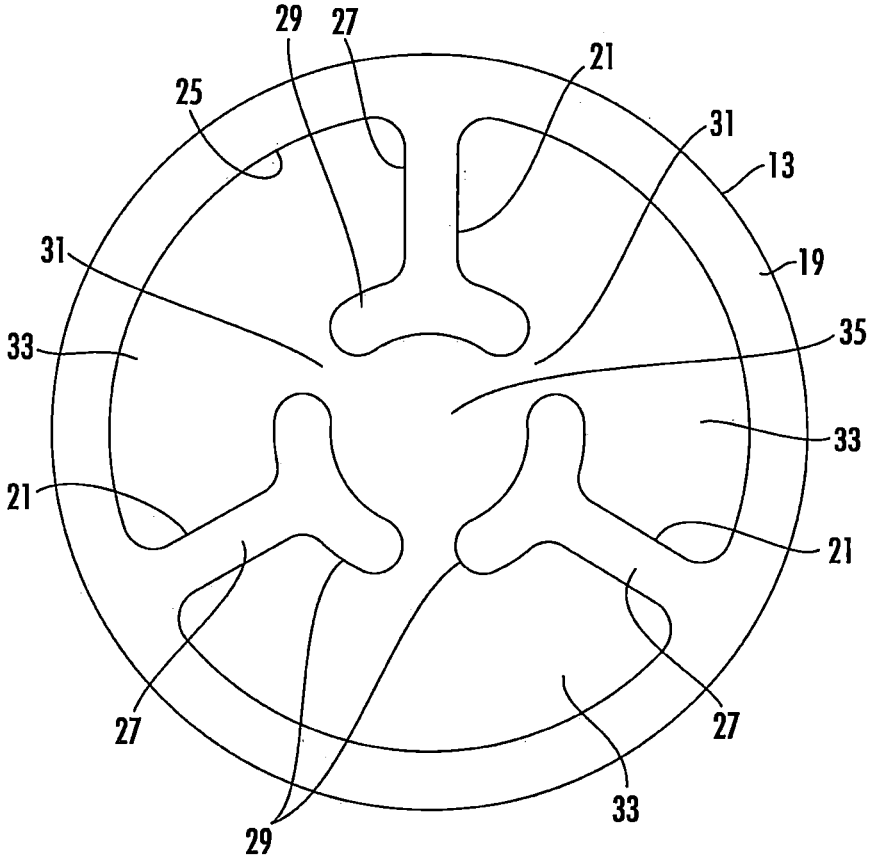
FIG. 2 is a transverse cross-sectional view of the suppressor, taken through lines II-II of FIG. 1.
Figure 3:
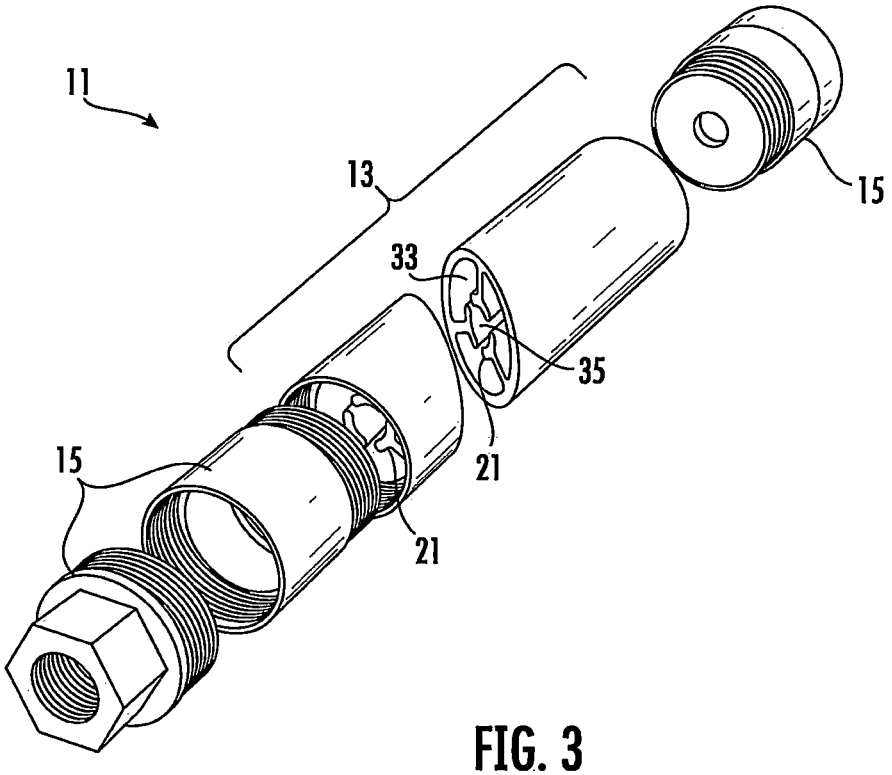
FIG. 3 is an exploded perspective view of the suppressor, with the core portion sectioned diagonally to illustrate the internal structure of the core.
Figure 4:
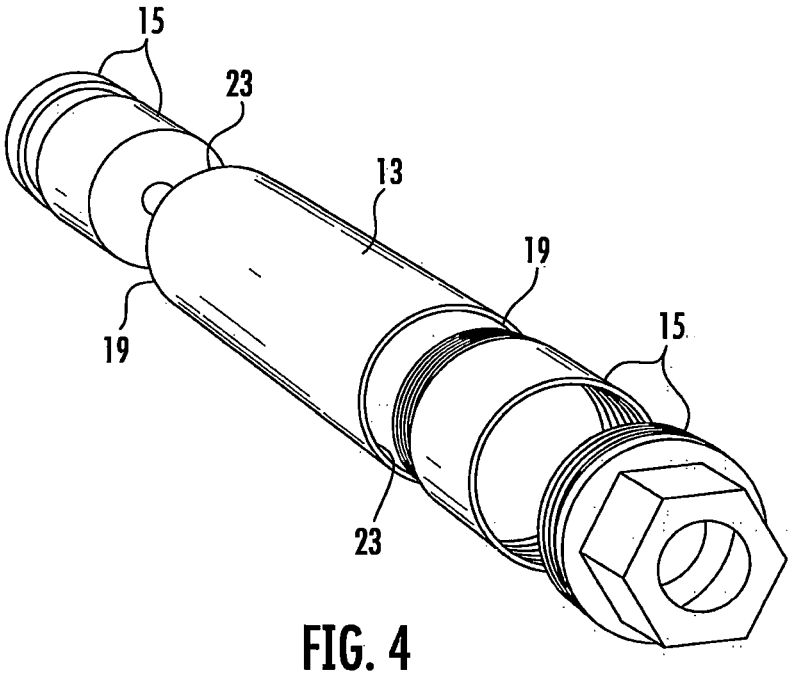
FIG. 4 is another isometric exploded perspective view of the suppressor.

Referring to FIGS. 1-4, the suppressor has a core 13 and adapters 15 at each end of the core 13. Each of these will be described in turn.

The core 13 has a cylindrical tube 19 or sleeve and interior partitions 21 or vanes. The tube has two ends 23 that are open and an inner surface 25. The partitions 21 are located inside the tube and extend between the two ends 23. Each partition 21 includes a flat plate 27 that extends from the inner surface 25 of the tube 19 in a radially inward direction. Each partition 21 also includes an arcuate component 29. The arcuate component 29 is located at the inner or free end of the plate 27.

The core 13 has plural partitions 21 therein. The plates 27 are spaced equidistantly apart from one another. The arcuate components 29 circumscribe a circle that is concentric with the tube 19. Each arcuate component 29 circumscribes a smaller angle than the spacing between the plates, in order to provide a gap 31 between the arcuate components 29. For example, in the preferred embodiment, there are three partitions 21 shown, with each partition plate 27 located approximately 120 degrees apart, on-center, from the adjacent partition plates 27. Each arcuate component 29 circumscribes an angle of 90-100 degrees.

The partitions 21 are separated from one another by baffle, or outer, cavities 33. Each outer cavity 33 is bounded by the adjacent plates 27, the tube inner surface 25 and the arcuate components 29. Each outer cavity communicates with an inner cavity 35 located between the arcuate components 29. The inner cavity 35 communicates with the outer cavities 33 through the gaps 31. The outer cavities 33 do not directly communicate with one another, but indirectly communicate through the inner cavity 35.

The inner cavity 35 forms the path for the projectile. The suppressor is sized for the specific caliber projectile. The inside diameter of the inner cavity 35 is slightly larger than the caliber of the projectile. The inside diameter of the inner cavity 35 is sufficiently large so that the partitions 21 do not contact or interfere with the passage of the projectile along the path. Thus, the projectile passes the length of the inner cavity 35 without contacting the partitions 21 and the arcuate components 29. The inside diameter of the inner cavity 35 is not too large however, in order to provide relatively large outer cavities 33. The partitions 21 project sufficiently far inward so as to form the outer cavities 33. The larger the outer cavities 33, the more volume available for suppression and the better the noise reduction.

There are plural partitions 21. In practice, suppressors having 2, 3 or 4 partitions 21 have been built and tested. The suppressors 11 with 3 partitions 21 have better noise suppression.

In addition to the core 13, an adapter 15 is coupled at each end of the core 13. A barrel adapter is provided at one end so as to allow securing of the suppressor to a firearm barrel. A typical way to secure the suppressor 11 to a barrel is by a threaded arrangement. A downstream adapter is provided at the opposite end to close the end of the core. The projectile path extends through the adapters and the core 13.

The core 13 is manufactured separately from the adapters. The adapters are coupled to the core 13 such as by welding or by a threaded coupling if the suppressor 11 is designed to be disassembled for cleaning. The core 13 and adapters 15 are made of metal.

In use, the suppressor 11 is mounted to the firearm in a conventional manner. For example, the suppressor 11 may be threaded onto the end of the firearm barrel. This allows the firearm to be operated with or without the suppressor 11. The firing of the firearm propels the projectile out of the barrel and through the suppressor inner cavity 35. The propellant gasses from the burning powder exit the firearm barrel, enter the suppressor inner cavity 35, and expand into the outer cavities 33. The partitions 21 retard some of the movement of the gasses between cavities 33. The outer cavities 33 allow the hot gasses to cool and condense before exiting the suppressor 11 through the projectile outlet. Such action reduces the noise of the firing of the firearm.

The foregoing disclosure and showings made in the drawings are merely illustrative of the principles of this invention and are not to be interpreted in a limiting sense.

The invention claimed is:

1. A firearm suppressor comprising:

a core comprising a tube and plural interior vanes;

the tube having first and second ends and an inner surface;

the first and second ends being open;

the vanes being located inside the tube and extending between the first and second ends;

the vanes each having an extension member and an arcuate component;

the extension member extending radially inward from the tube inner surface such that an extension member outer end is nearer the tube inner surface than an extension member free end;

the arcuate component being located at the extension member free end;

the arcuate components collectively circumscribing a circle;

the respective vanes being separated from one another by respective outer cavities, the respective outer cavities defined by the tube inner surface, the respective extension members and the respective arcuate components;

the outer cavities being in fluid communication with an inner cavity located between the arcuate components;

the inner cavity being structured and arranged to form a projectile path for a projectile when the projectile is caused to move longitudinally through the firearm suppressor;

an inside diameter of the inner cavity being larger than a caliber of the projectile, such that the vanes do not contact or interfere with passage of the projectile along the projectile path when the projectile is caused to move longitudinally through the firearm suppressor.

2. The firearm suppressor of claim 1, wherein the extension members are positioned equidistant apart from one another.

3. The firearm suppressor of claim 2, wherein each arcuate component circumscribes an angle ranging between 90 and 100 degrees, inclusive.

4. The firearm suppressor of claim 1, wherein the circle circumscribed by the arcuate components is concentric with the tube.

5. The firearm suppressor of claim 1, having two, three, or four vanes.

6. The firearm suppressor of claim 1, further comprising:

first and second adaptors;

the first adaptor being coupled at the first end of the tube;

the second adaptor being coupled to the second end of the tube;

the projectile path extending through the adaptors and the core.

7. The firearm suppressor of claim 6, wherein the adaptors are removably coupled to the core.

8. The firearm suppressor of claim 7, wherein the adaptors are threadedly coupled to the core.

9. The firearm suppressor of claim 6, the first adaptor being structured and arranged to be coupled to a firearm.

10. The firearm suppressor of claim 9, the second adaptor being structured and arranged to close a portion of the second end of the tube.

11. A firearm suppressor comprising:

a core comprising a tube and plural interior vanes;

the tube having first and second ends and an inner surface;

the first and second ends being open;

the vanes being located inside the tube and extending between the first and second ends;

the vanes each having an extension member and an arcuate component;

the extension member extending radially inward from the tube inner surface such that an extension member outer end is nearer the tube inner surface than an extension member free end;

the arcuate component being located at the extension member free end;

the arcuate components collectively circumscribing a circle concentric with the tube;

the respective vanes being separated from one another by respective outer cavities, the respective outer cavities defined by the tube inner surface, the respective extension members and the respective arcuate components;

the outer cavities being in fluid communication with an inner cavity located between the arcuate components;

the inner cavity being structured and arranged to form a projectile path for a projectile when the projectile is caused to move longitudinally through the firearm suppressor;

an inside diameter of the inner cavity being larger than a caliber of the projectile, such that the vanes do not contact or interfere with passage of the projectile along the projectile path when the projectile is caused to move longitudinally through the firearm suppressor;

the extension members being positioned equidistant apart from one another;

the arcuate components circumscribing an angle ranging between 90 and 100 degrees, inclusive.

12. The firearm suppressor of claim 11, having two, three, or four vanes.

13. The firearm suppressor of claim 11, further comprising:

first and second adaptors;

the first adaptor being coupled at the first end of the tube;

the second adaptor being coupled to the second end of the tube;

the projectile path extending through the adaptors and the core.

14. The firearm suppressor of claim 13, wherein the adaptors are removably coupled to the core.

15. The firearm suppressor of claim 14, wherein the adaptors are threadedly coupled to the core.

16. The firearm suppressor of claim 13, the first adaptor being structured and arranged to be coupled to a firearm.

17. The firearm suppressor of claim 16, the second adaptor being structured and arranged to close a portion of the second end of the tube.

* * * * *